US006378475B2

(12) United States Patent
Takenaka et al.

(10) Patent No.: US 6,378,475 B2
(45) Date of Patent: Apr. 30, 2002

(54) VALVE TIMING ADJUSTING DEVICE

(75) Inventors: Akihiko Takenaka, Anjo; Isao Hattori, Gifu; Michio Adachi, Obu, all of (JP)

(73) Assignee: Densco Corporation, Kariya (JP)

( * ) Notice: Subject to any disclaimer, the term of this patent is extended or adjusted under 35 U.S.C. 154(b) by 0 days.

(21) Appl. No.: 09/875,180

(22) Filed: Jun. 7, 2001

(30) Foreign Application Priority Data

Jun. 9, 2000 (JP) ..... 2000-174104

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,738,056 A 4/1998 Mikame et al. ..... 123/90.17
6,035,819 A * 3/2000 Nakayoshi et al. ..... 123/90.17
6,062,182 A 5/2000 Ogawa ..... 123/90.17
6,311,655 B1 * 11/2001 Simpson et al. ..... 123/90.17

FOREIGN PATENT DOCUMENTS

JP 11343819 12/1999

* cited by examiner

*Primary Examiner*—Weilun Lo
(74) *Attorney, Agent, or Firm*—Nixon & Vanderhye P.CC

(57) ABSTRACT

A spool is moved by controlling the amount of electric current supplied to a linear solenoid of a changeover valve, and selects any one of valve sections. The state of communication between fluid passages connected to the changeover valve is determined by the valve section and selected. With the selection of the valve section, the hydraulic fluid is discharged from the advance oil pressure chamber while being supplied to the advance oil pressure chamber, and also is discharged from the retard oil pressure chamber. The oil pressure in the advance oil pressure chamber remains low even when the oil is filled in the advance oil pressure chamber.

18 Claims, 10 Drawing Sheets

VALVE TIMING ADJUSTING DEVICE

CROSS REFERENCE TO RELATED APPLICATION

This application is based on and incorporates herein by reference Japanese Patent Application No. 2000-174104 filed on Jun. 9, 2000.

BACKGROUND OF THE INVENTION

1. Field of the Invention

The present invention relates to a valve timing adjusting device for changing valve opening-closing timing suitable for use in intake and exhaust valves of an internal combustion engine.

2. Description of Related Art

As a conventional valve timing adjusting device, there is a well known vane-type device in which a camshaft is driven through a timing pulley, a chain sprocket, etc. which turn synchronously with an engine crankshaft. The valve timing of at least any one of an intake valve and an exhaust valve is hydraulically controlled by a phase difference of relative rotation of the timing pulley, the chain sprocket, and the camshaft. Engine output and fuel consumption ratio are improved by adjusting the phase difference between the crankshaft and the camshaft to an optimum value in accordance with engine operating state.

In such a vane-type valve timing adjusting device using operation oil, when at least any one of the intake valve and the exhaust valve is actuated, the camshaft receives a load torque which varies between positive and negative loads. Therefore, when the operation oil is not sufficiently supplied during cranking of the engine, there might arise such a problem that a vane member oscillates with respect to a housing member containing the vane member, thereby hitting against the housing member to produce knocks. The positive load torque is applied in the retarding direction of the camshaft with respect to the crankshaft, and the negative load torque is added in the advancing direction of the camshaft with respect to the crankshaft. Average positive and negative load torques is added in the retarding direction of the camshaft with respect to the crankshaft.

There has been such a well known device that, in case of insufficient supply of operation oil to the valve timing adjusting device, occurrence of knocks is prevented by preventing the vane member from oscillating with respect to the housing member by fitting a stopper piston in a fitting hole formed in the housing member. Therefore, when the operation oil is sufficiently supplied, the stopper piston is moved by the oil pressure out of the housing member, thereby enabling the control of rotation of the vane member with respect to the housing member.

Here, it is possible to reduce a pumping loss of the engine for improving the fuel consumption ratio by retarding the intake valve closing timing over the BDC position of a piston. However, when the intake valve closing timing is retarded over the BDC position of the piston, the fuel consumption ratio is improved after an engine warm-up, but a real compression ratio becomes lower at the time of cold engine, so that the air temperature does not sufficiently rise at the top dead center (TDC) of the piston. Thus, the engine might fail in starting. In this case, an optimum valve timing of the intake valve during the period of engine cooling is at the advance side of an optimum valve timing after the engine warm-up.

Therefore, it is considered to start the engine with certainty by fitting the stopper pin in the fitting hole to stop the engine when the vane member is in an intermediate position between the most advanced angle and the most retarded angle with respect to the housing member, and then by starting the engine when the vane member is in the intermediate position. As the valve timing adjusting device described above are disclosed in JP-A-9-324613 and JP-A-11-343819.

Generally, when the engine is stopped, the oil pressure added to each oil pressure chamber drops, and the vane member is turned to the retard side with respect to the housing member by a load torque applied to the camshaft. Therefore, when the vane member is positioned at the advance side over the intermediate position with respect to the housing member, the vane member is rotated to the retard side by the load torque when the engine is stopped and reaches the intermediate position to allow the stopper piston to fit in the fitting hole.

However, when the vane member is at the advance side of the intermediate position with respect to the housing member, the engine might stop due to increased viscosity of the operation oil during a cold engine even when the load torque is applied to the camshaft while an engine does not operate. Even when the engine is stopped in such a condition that the vane member is at the advance side of the intermediate position with respect to the housing member, the load torque is applied to the camshaft during the engine cranking, and the vane member rotates to the retard side with respect to the housing member when the engine starts. Then, the stopper piston fits in the fitting hole, thereby starting the engine at the intermediate position.

However, when the engine is started up immediately after the engine stop, the oil pressure is added to the oil pressure chamber because the oil is filled in an oil passage. When the operation oil is supplied to the advance oil pressure chamber after the engine startup, the oil pressure in the advance oil pressure chamber increases before the vane member receiving the load torque turns to the retard side, thereby causing the vane member to be placed at the advance side of the intermediate position. In the case of the intake valve for example, when the engine is started up while the intake valve opening timing is advanced, the exhaust valve opening timing and the intake valve opening timing overlap each other, thereby failing in starting the engine up.

In the valve timing adjusting device disclosed in JP-A-11-343819, the operation oil is discharged out of the advance oil pressure chamber and the retard oil pressure chamber during engine startup, thereby allowing the vane member to rotate to the retard side at the time of engine startup.

However, since no operation oil is supplied to both the advance oil pressure chamber and the retard oil pressure chamber, sliding parts of members are not supplied with the operation oil at the time of engine startup, so that the sliding parts of members are likely to be seized up. Further, while no operation oil is supplied to both oil pressure chambers, when the stopper piston comes out of the fitting hole, the vane member is likely to turn to the advance side by the load torque, so go that the vane member hits against the housing member.

SUMMARY OF THE INVENTION

An object of the present invention is to provide a valve timing adjusting device in which a driven-side rotor is held at an intermediate position with respect to a driving-side rotor when the engine starts, for preventing seizure of sliding parts during engine startup operation and occurrence of knocks.

According to the valve timing adjusting device in the present invention, when the engine is stopped when the drive-side rotor is at an advance side of the intermediate position with respect to the driving-side rotor, the hydraulic fluid can be discharged from an advance chamber to a drain while supplying the hydraulic fluid from a fluid supply source to the advance chamber by simultaneously connecting the advance fluid passage to the fluid supply source, and the advance fluid passage to the drain, at the time of engine startup. Since the advance chamber fluid pressure remains low even when the hydraulic fluid is filled in the advance chamber, the driven-side rotor rotates to the retard side with respect to the driving-side rotor when the load torque is applied to the driven-side rotor at the time of engine startup. When the driven-side rotor reaches the intermediate position, a contacting portion contacts a contacted portion, thereby holding the driven-side rotor at the intermediate position with respect to the driving-side rotor. By setting the intermediate position at the optimum phase, the engine can be reliably started up. Upon engine starting up, the hydraulic fluid pressure rises to move the contacting portion away from the contacted portion, so that rotation of the driven-side rotor with respect to the driving-side rotor is controlled.

Since the hydraulic fluid can be discharged out of the advance chamber while supplying the hydraulic fluid into the advance chamber during engine startup, the hydraulic fluid circulates in the advance fluid passage and the advance chamber. Since the hydraulic fluid lubricates sliding parts of each member from just after the beginning of engine startup, it is possible to prevent seizure of the member at the time of engine startup.

Since the advance chamber is full of the hydraulic fluid, though at a low pressure, at the time of engine startup, the driven-side rotor is prevented from rotating to the retard side to hit against the driving-side rotor even when the contacting portion is released from the contacted portion.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 3:
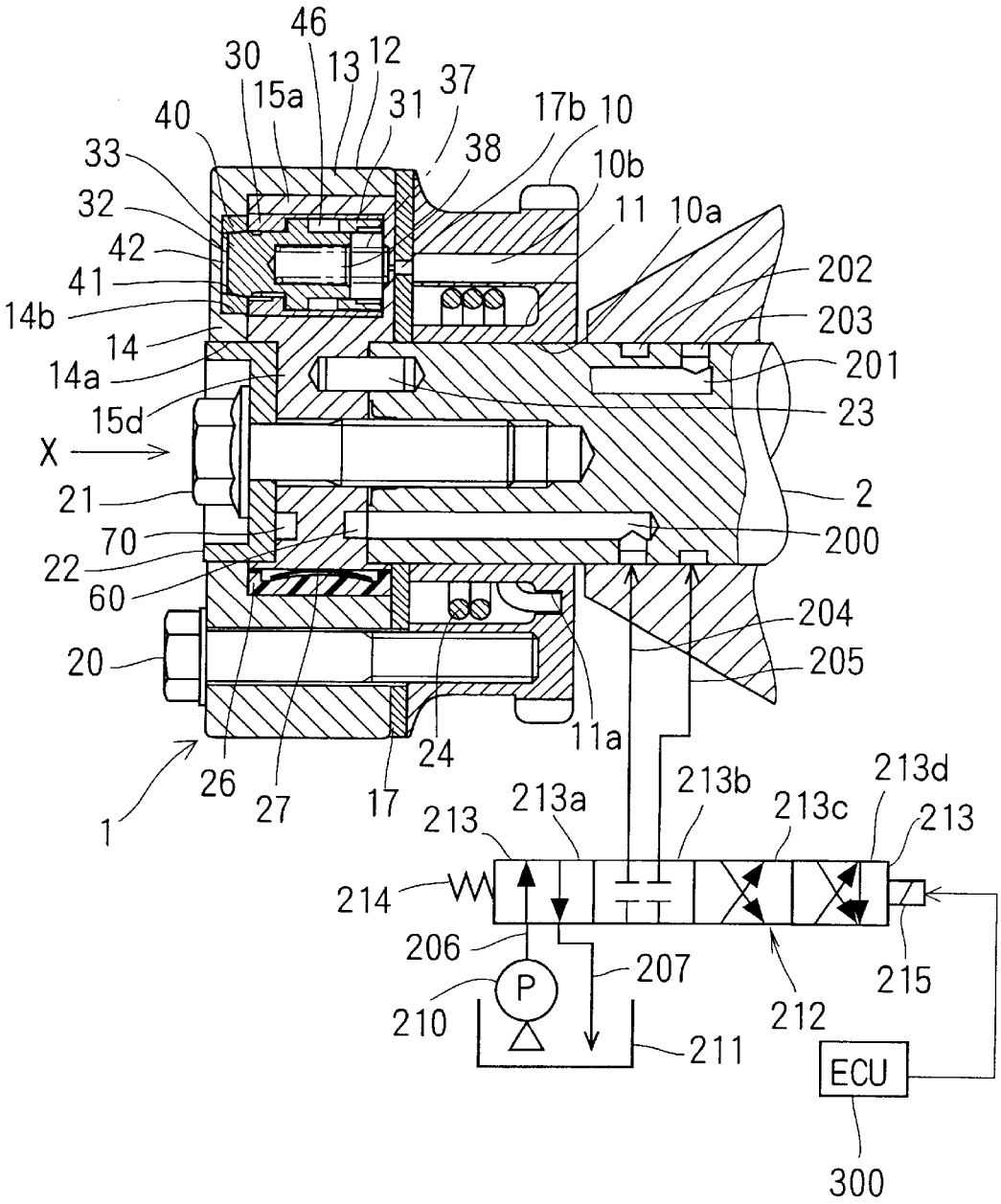
FIG. 3 is a cross-sectional view taken along line III—III in FIG. 2 (first embodiment)

FIG. 3 shows an engine valve timing adjusting device 1 of the first embodiment. The valve timing adjusting device 1 is of a hydraulic pressure control type and controls an intake valve timing.

A chain sprocket 10 is connected to a crankshaft as a drive shaft of the engine and receives a driving force through a chain. The chain sprocket 10 rotates in synchronization with the crankshaft. The driving force is transmitted to the camshaft 2 as a driven shaft through the chain sprocket 10. The camshaft opens and closes the intake valve. The camshaft 2 is rotatable with respect to the chain sprocket 10 by a predetermined phase difference. The chain sprocket 10 and the camshaft 2 rotate clockwise as viewed in the direction of the arrow X in FIG. 3. Hereinafter, this rotational direction defines an advance direction.

Between the chain sprocket 10 and a set of shoe housing 12 and vane rotors 15, a disk-shaped intermediate plate 17 is provided. The intermediate plate 17 prevents oil leaks from between the chain sprocket 10 and the set of shoe housing 12 and vane rotors 15. The chain sprocket 10, the shoe housing 12, and the intermediate plate 17 forms a housing member and works as a driving-side rotor, and coaxially secured by a bolt 20.

Figure 2:
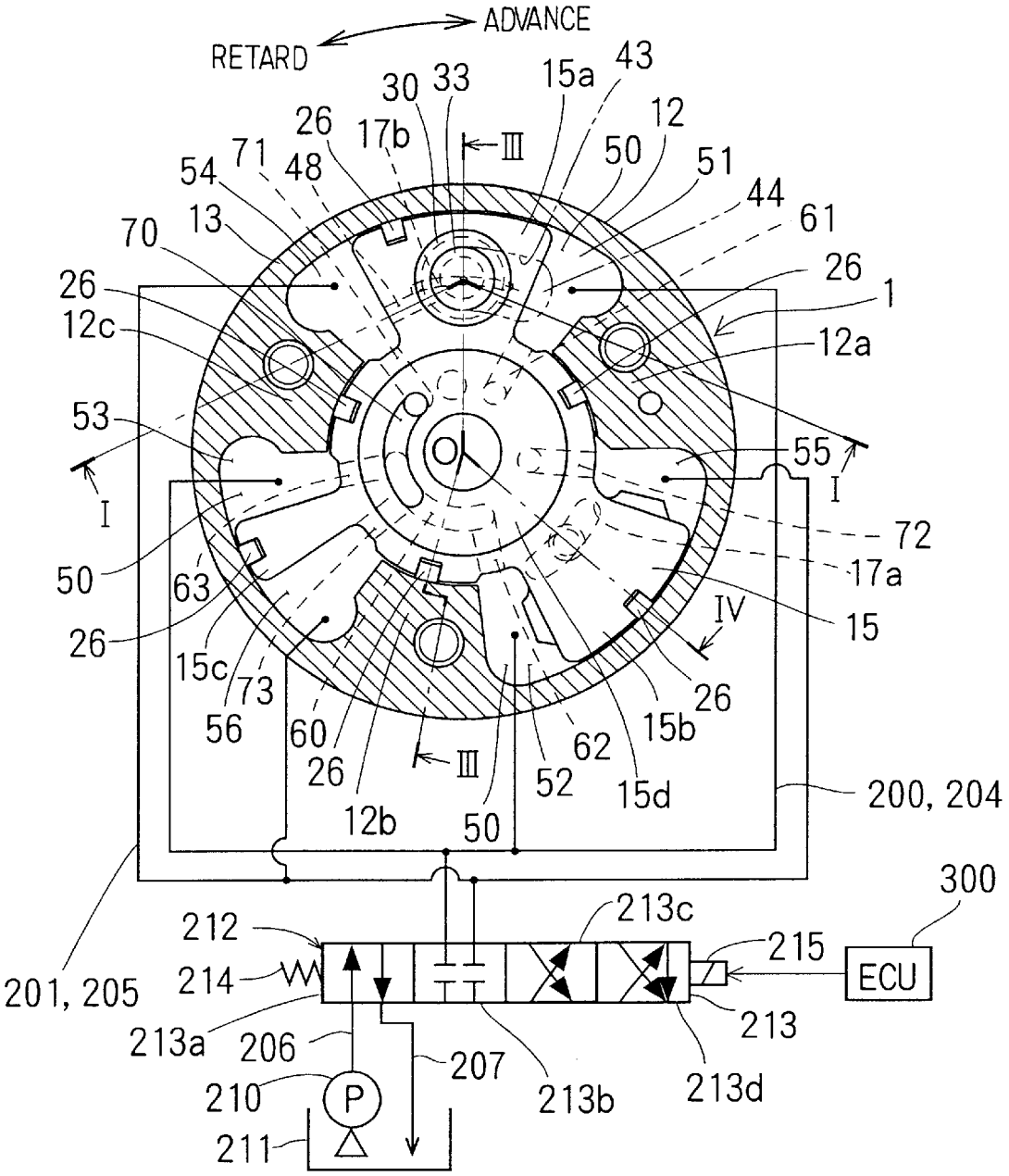
FIG. 2 is a cross-sectional showing the valve timing adjusting device (first example)

The shoe housing 12 integrally includes a side wall 13 and a front plate 14. As shown in FIG. 2, the shoe housing 12 includes shoes 12*a*, 12*b* and 12*c* formed in a trapezoidal shape and circumferentially arranged at approximately equal spacing intervals. In three spaces provided in the circumferential direction of the shoes 12*a*, 12*b* and 12*c*, housing chambers 50 for containing vanes 15*a*, 15*b* and 15*c* are formed. The inner peripheral surfaces of the shoes 12*a*, 12*b* and 12*c* are formed in an arc in cross section.

The vane rotor 15 includes vanes 15*a*, 15*b* and 15*c* arranged at approximately equal spacing intervals in the circumferential direction. The vanes 15*a*, 15*b* and 15*c* are rotatably accommodated within each of housing chambers 50. Each vane divides the housing chamber 50 into a retard hydraulic fluid chamber and an advance hydraulic fluid chamber. Arrows in FIG. 2 indicating retard and advance directions indicate the retard and advance directions of the vane rotor 15 with respect to the shoe housing 12. The most retarded position of the vane rotor 15 with respect to the shoe housing 12 is determined by contact of the vane 15*b* with the shoe 12*a*. The most advanced position of the vane rotor 15 with respect to the shoe housing 12 is determined by contact of the vane 15*b* with the shoe 12*b*. As shown in FIG. 3, the vane rotor 15 and a bushing 22 are integrally fixed by a bolt 21 on the camshaft 2, and form a driven-side rotor. A pin 23 determines the positioning of the vane rotor 15 in the rotational direction with respect to the camshaft 2.

The camshaft 2 and the bushing 22 are correlatively rotatably fitted in the inner wall 10*a* of the chain sprocket 10 and in the inner wall 14*a* of the front plate 14. Therefore, the camshaft 2 and the vane rotor 15 are coaxially correlatively rotatable with respect to the chain sprocket 10 and the shoe housing 12. The inner wall 10*a* of the chain sprocket 10 and the inner wall 14*a* of the front plate 14 work as bearings for supporting the driven-side rotor.

Figure 4:
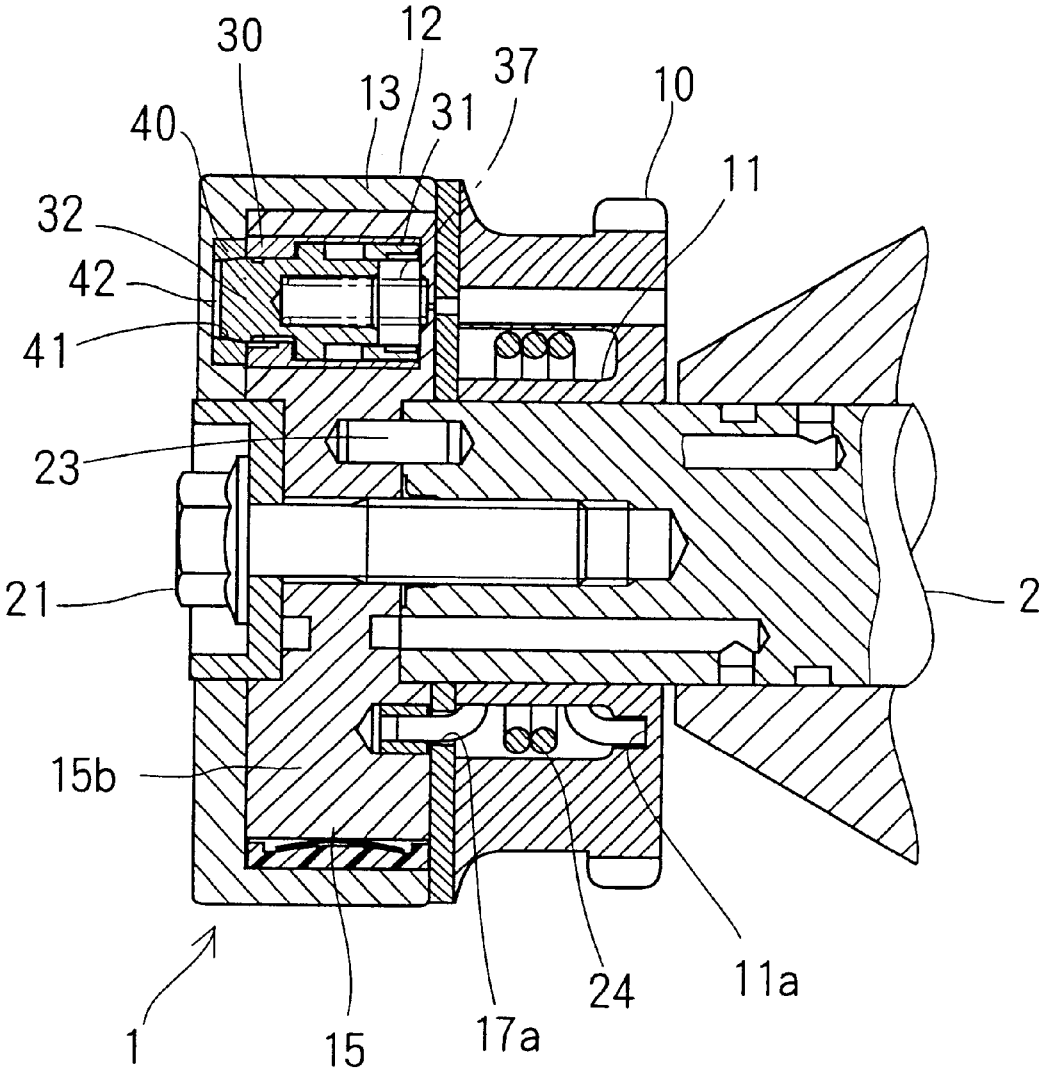
FIG. 4 is a cross-sectional view taken long line IV—IV in FIG. 2 (first embodiment)

A spring 24 is installed in a cylindrical recess 11 formed in the chain sprocket 10. The spring 24 is retained at one end by the retaining portion 11*a* of the recess 11 and at the other end by the vane rotor 15 as shown in FIG. 4 through a long hole 17*a* formed in the intermediate plate 17 shown in FIGS. 2 and 4.

The load torque which the camshaft 2 receives while driving the intake valve varies to both positive and negative sides. Here, the positive direction of the load torque is the retard direction of the vane rotor 15 with respect to the shoe housing 12, while the negative direction of the load torque is the advance direction of the vane rotor 15 with respect to the shoe housing 12. An average load torque is applied in the positive direction, that is, in the retard direction. The urging force of the spring 24 works as a torque to rotate the vane rotor 15 to the advance side with respect to the shoe housing 12. The torque of the spring 24 acting on the vane rotor 15 in the advance direction is almost the same as the average load torque acting on the camshaft 2.

A seal member 26 is fitted in the outer peripheral wall of the vane rotor 15 as shown in FIG. 2. Between the outer peripheral wall of the vane rotor 15 and the inner peripheral wall of the side wall 13, a very small clearance is provided. The seal member 26 prevents the hydraulic fluid from leaking between the hydraulic fluid chambers through the clearance. The seal member 26 is pressed toward the side wall 13 by the force of the plate spring 27 shown in FIG. 3.

Figure 1:
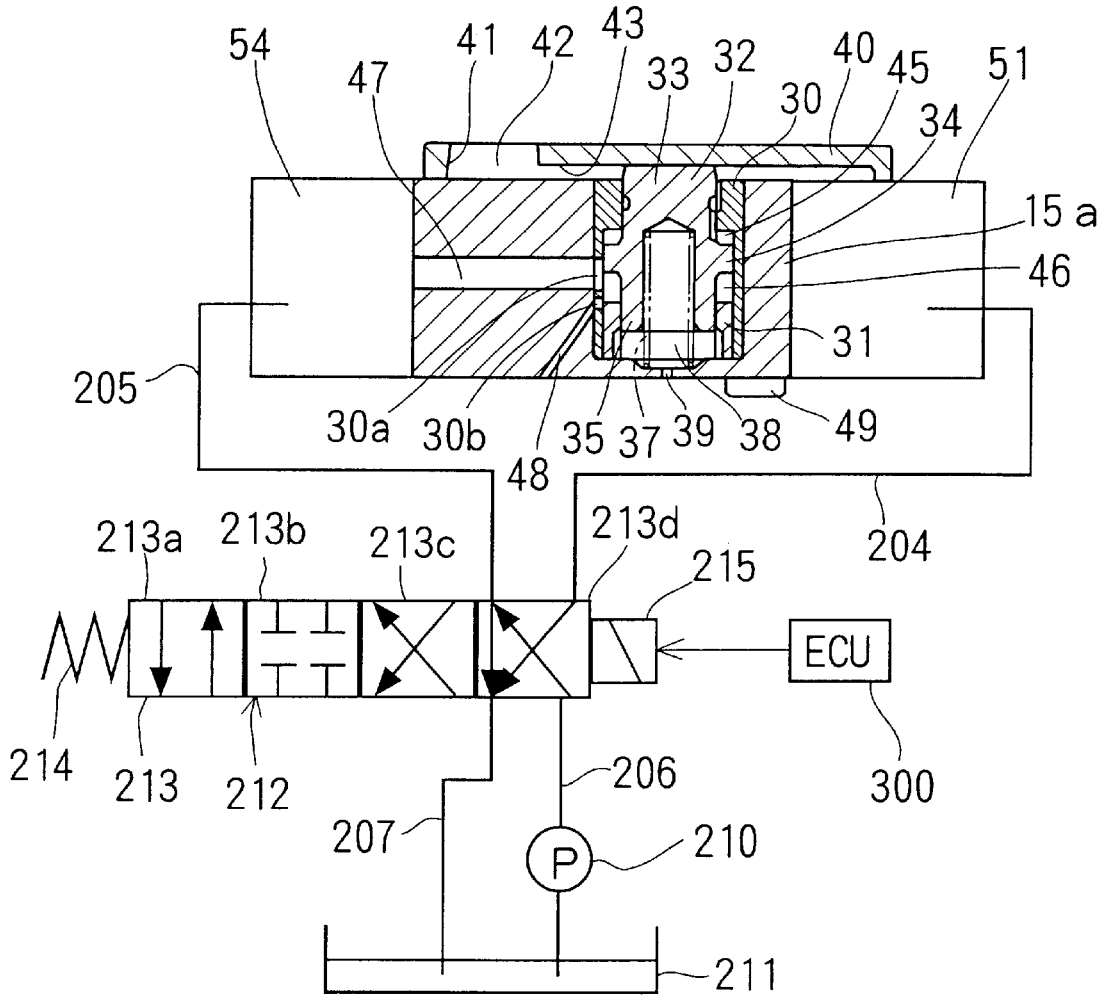
FIG. 1 is a schematic view showing a cross-sectional view taken along line I—I in FIG. 2 showing a valve timing adjusting device and showing a changeover valve (first embodiment)

A guide ring 30 is pressed and retained in the inner wall of the vane 15*a* forming the housing hole 38. A guide ring 31 is pressed and retained in the inner wall of the guide ring 30. A cylindrical stopper piston 32 as a contacting portion is provided in the guide rings 30 and 31, and is slidable in the axial direction of the camshaft 2. A fitting member 40 as a contacted portion formed in a circle in cross section is pressed and retained in recess 14*b* formed in the front plate 14. As shown in FIG. 1, in the fitting member 40, a fitting hole 41 in which the stopper piston 32 can be fitted to contact the fitting member 40, and an enlarged hole 43 extended on the advance side which is shallower than the fitting hole 41, and has a retard-side end face on the same plane as the retard-side end face of the fitting hole 41.

The stopper piston 32 is formed in a cylindrical shape having a bottom and has a first small-diameter portion 33, a large-diameter portion 34, and a second small-diameter portion 35 as viewed from the fitting member 40. The first small-diameter portion 33 is tapered as it goes to ward the fitting direction. Since the fitting hole 41 is also tapered at approximately the same angle of taper as the inclination of the first small-diameter portion 33, the stopper piston 32 can smoothly fit in the fitting hole 41. Furthermore, since the stopper piston 32 tightly fits in the fitting hole 41, it is possible to prevent occurrence of knocks likely to be produced by load torque variations. Furthermore, since the first small-diameter portion 33 being in contact with the fitting hole 41, has a large contact surface area, the first small-diameter portion 33 receives small stress, thereby improving a durability of the stopper piston 32.

A spring 37 in FIG. 1 urges the stopper piston 32 toward the fitting member 40. A restraining means in the present invention includes the stopper piston 32, the fitting member 40 and the spring 37.

The first small-diameter portion 33 of the stopper piston 32 can fit in the fitting hole 41 when the vane rotor 15 is nearly in the intermediate position between the most retarded position and the most advanced position with respect to the shoe housing 12 as shown in FIG. 2. When the stopper piston 32 is fitted in the fitting hole 41, the relative rotation of the vane rotor 15 with respect to the shoe housing 12 is restrained. In the intermediate position, the relative rotation of the vane rotor 15 with respect to the shoe housing 12 is restrained with the stopper piston 32 fitted in the fitting hole 41. In this intermediate position, the phase difference of the camshaft 2 from the crankshaft, that is, the intake valve timing is set in optimum such that the engine can be reliably started up.

When the stopper piston 32 is withdrawn out of the fitting hole 41, the vane rotor 15 is relatively rotatable with respect to the shoe housing 12.

As shown in FIG. 1, the front end face of the first small-diameter portion 33 receives the retard oil pressure from an oil pressure chamber 42. Annular surface formed on the fitting hole 41 side of the large-diameter portion 34 receives an advance oil pressure from an oil pressure chamber 45 when an oil passage 47 formed by the oil pressure chamber 45 and the vane 15*a* is not closed by the large-diameter portion 34. The oil pressure that the stopper piston 32 receives from the oil pressure chambers 42 and 45 are applied in the direction in which the stopper piston 32 moves out of the fitting hole 41. The oil pressure chamber 42 communicates with a retard oil pressure chamber 51 through an oil passage (not illustrated) formed in the front plate 14. The oil pressure chamber 45 communicates with an advance oil pressure chamber 54 through a through hole 30*a* formed in the guide ring 30 and an oil passage.

A damper chamber 46 communicates with an oil passage 48 through a through hole 30*b* formed in the guide ring 30. A recess space 49 is formed on the sliding side of the intermediate plate 17 on which the vane 15*a* slides. The recess space 49 can communicate with the advance oil pressure chamber 54 and the oil passage 48, that is, with the damper chamber 46, in accordance with the relative rotational position of the vane rotor 15 with respect to the shoe housing 12. The connection of the advance oil pressure chamber 54 with the damper chamber 46 is interrupted by the sliding surface of the vane rotor 15 and the intermediate plate 17. The advance oil pressure chamber 54 communicates with the damper chamber 46 through the recess space 49 when the vane rotor 15 rotates to the advance side with respect to the shoe housing 12 over the intermediate position where the stopper piston 32 fits in the fitting hole 41.

When the damper chamber 46 is disconnected from the advance oil pressure chamber 54, the damper chamber 46 is hermetically sealed. When the damper chamber 46 is hermetically sealed, the damper chamber 46 operates as a damper to decrease the speed of movement of the stopper piston 32 toward the fitting hole 41. The damper chamber 46 is opened when the damper chamber 46 communicates with the advance oil pressure chamber 54. When the damper chamber 46 is opened and ceases to function as a damper, the stopper piston 32 can easily move toward the fitting hole 41. In this way, the opening and hermetically sealing of the damper chamber 46 is changed over by the relative rotational position of the vane rotor 15.

As shown in FIG. 3, the housing hole 38 formed on the opposite side of the fitting member of the stopper piston 32 is constantly open to the atmosphere within the range of relative rotation angle of the vane rotor 15 through a through hole 39 formed in the vane 15*a*, a communicating hole 17*b* extending in the peripheral direction formed in the intermediate plate 17, and an oil passage 10*b* formed in the chain sprocket 10. Therefore, the reciprocating movement of the stopper piston 32 will not be disturbed.

As shown in FIG. 2, the retard oil pressure chamber 51 is formed between the shoe 12*a* and the vane 15*a*; a retard oil pressure chamber 52 is formed between the shoe 12*b* and the vane 15*b*; and a retard oil pressure chamber 53 is formed between the shoe 12*c* and the vane 15*c*. Similarly, the advance oil pressure chamber 54 is formed between the shoe 12*c* and the vane 15*a*; an advance oil pressure chamber 55 is formed between the shoe 12*a* and the vane 15*b*; and an advance oil pressure chamber 56 is formed between the shoe 12*b* and the vane 15*c*.

The retard oil pressure chamber 51 communicates with an oil passage 61. And the retard hydraulic fluid chambers 52 and 53 communicate with an oil passage 60 shown in FIG. 2 formed in a C-letter shape in the end face of the camshaft 2 side of the boss portion 15*d* through oil passages 62 and 63. Furthermore, the retard oil pressure chambers 51, 52 and 53 communicate with an oil passage 200 formed in the camshaft 2 shown in FIG. 3 through the oil passages 60 and 61. The advance oil pressure chamber 55, as shown in FIG. 2, communicates with an oil passage 72. The advance oil pressure chambers 54 and 56 communicate with an oil passage 70 formed in a C-letter shape in the end face on the bushing 22 side of the boss portion 15*d* through oil passages 71 and 73. Furthermore, the advance oil pressure chambers 54, 55 and 56 communicate, from the oil passages 70 and 72, with an oil passage 201 formed in the camshaft 2 shown in FIG. 3, through an oil passage (not illustrated) formed in the axial direction of the boss portion 15*d*.

The oil passage 200 communicates with a groove passage 202 formed in the outer peripheral wall of the camshaft 2; and the oil passage 201 communicates with a groove passage 203 formed in the outer peripheral wall of the camshaft 2. The groove passage 202 is connected with a changeover valve 212 as a changeover means through a retard oil passage 104; and a groove passage 203 is connected with the changeover valve 212 through an advance oil passage 205. An oil supply passage 206 is connected to an oil pump 210. An oil discharge passage 207 is open to a drain 211. The oil pump 210 supplies the operation oil drawn up from the drain 211 to each oil pressure chamber through the changeover valve 212.

The changeover valve 212 is an electromagnetically-driven valve device having one spool 213 as a valve member. Valve sections 213*a*, 213*b*, 213*c*, and 213*d* indicate a position of the spool 213 with respect to a housing 231 (see FIG. 5) which reciprocally movably houses the spool 213, determining the state of connection between oil passages connected to the changeover valve 212. The spool 213 of the changeover valve 212 is urged in one direction by the spring 214, to slide reciprocally by controlling the supply of the electric current to the linear solenoid 215 as an electromagnetic driving section. The electric current to be supplied to the linear solenoid 215 is controlled by the engine control unit (ECU) 300. The ECU 300 receives signals of detection from various sensors, and sends signals to each device of the engine. As the spool 213 reciprocally moves, the combination of connection and disconnection among the oil passages 204, 205, the oil supply passage 206 and the oil discharge passage 207 is changed over.

Figure 5:
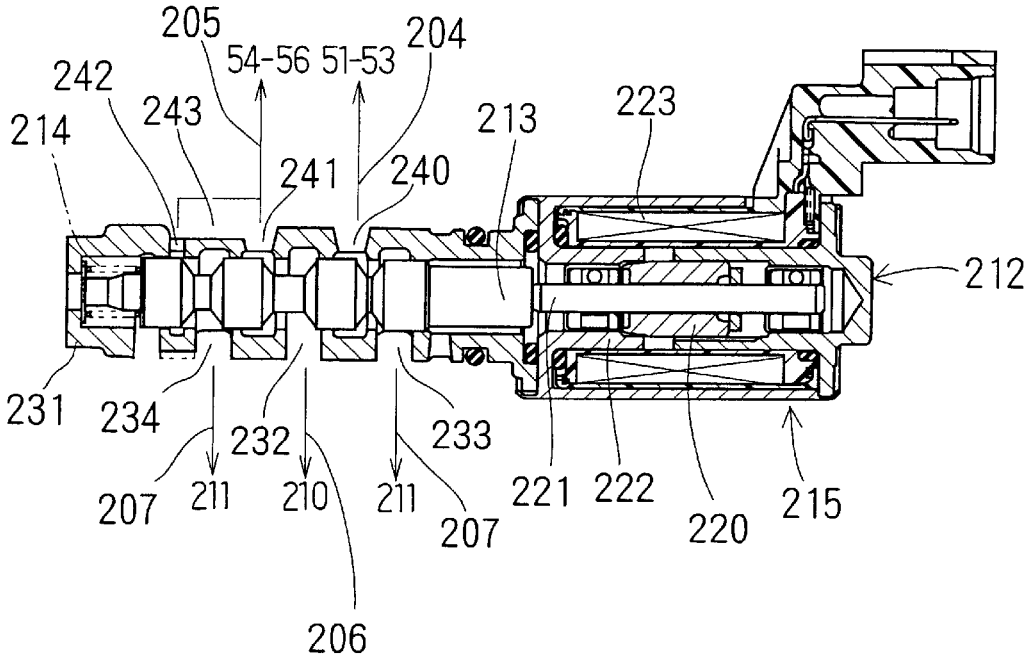
FIG. 5 is a cross-sectional view showing an operating state of the changeover valve (first embodiment)

Detailed structure of the changeover valve 212 is shown in FIG. 5. FIG. 5 shows a state that the linear solenoid 215 supplying the maximum electric current to a coil 223. A moving core 220 moves reciprocally together with a rod 221. When the coil 223 is energized, there is produced a magnetic force across a stationary core 222 and the moving core 220, and therefore the moving core 220 is attracted toward the stationary core 222.

On the spool 213, a plurality of lands are formed, each of which slides against the inner peripheral wall of the housing 231. The spring 214 urges the spool 213 in the opposite direction of the moving core 220 is attracted. The spool 213 is reciprocally movably supported by the housing 231, which is provided with a plurality of ports, or through holes, formed through the peripheral wall. In the housing 231, input port 232 through which the hydraulic fluid is fed, drain ports 233 and 234 through which the fluid is discharged, a retard port 240, an advance port 241, and a communication port 242 are formed. The input port 232 communicates with the fluid supply passage 206, through which the oil is supplied into the input port 232 by the oil pump 210. The drain ports 233 and 234 communicate with the oil discharge passage 207, and open to the drain 211. The retard port 240 communicates with each of the retard oil pressure chambers, and the advance port 241 communicates with each of the advance oil pressure chambers. Within the outer peripheral wall of the housing 231, a communication passage 243 through which the advance port 241 communicates with the communication port 242.

The ECU 300 controls the amount of the electric current to be supplied to the coil 223, thereby controlling the position of movement of the spool 213. With the increase in the amount of current to be supplied to the coil 223, the spool 213 moves toward the stationary core 222, that is, leftwardly in FIG. 5. When the maximum amount of current is supplied to the coil 223, the spool 213 is in a position shown in FIG. 5 against the urging force of the spring 214. At this time, the retard port 240 communicates with the drain port 233, and the advance port 241 communicates with the input port 232. The communication port 242 communicates with the drain port 234. The advance port 241 communicates with the communication port 242 through the communication passage 243, so that the oil is supplied by the oil pump 210 and is discharged from each advance oil pressure chamber.

Figure 6:
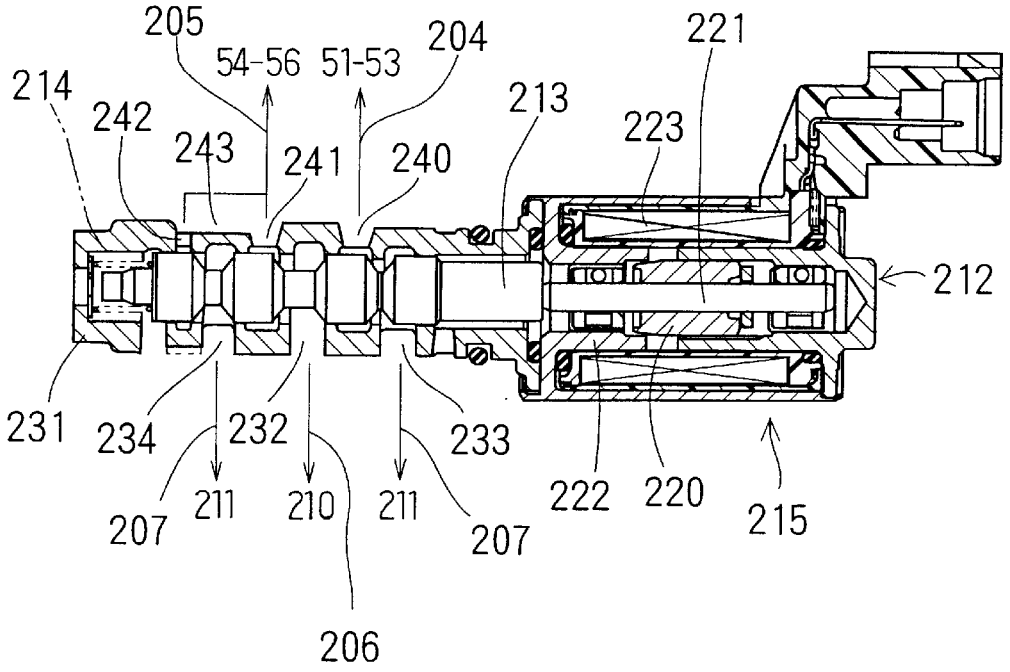
FIG. 6 is a cross-sectional view showing the operating state of the changeover valve (first embodiment)

When the amount of the electric current supplied into the coil 223 decreases more than the state shown in FIG. 5, the magnetic force attracting the moving core 220 toward the stationary core 222 decreases, and the spool 213 comes to a position shown in FIG. 6. The retard port 240 communicates with the drain port 233, and the advance port 241 communicates with the input port 232. However, the communication port 242 is shut off from communication with the drain port 234. Since the oil is supplied to the advance oil pressure chamber and is not discharged, the oil pressure in the advance oil pressure chamber increases.

Figure 7:
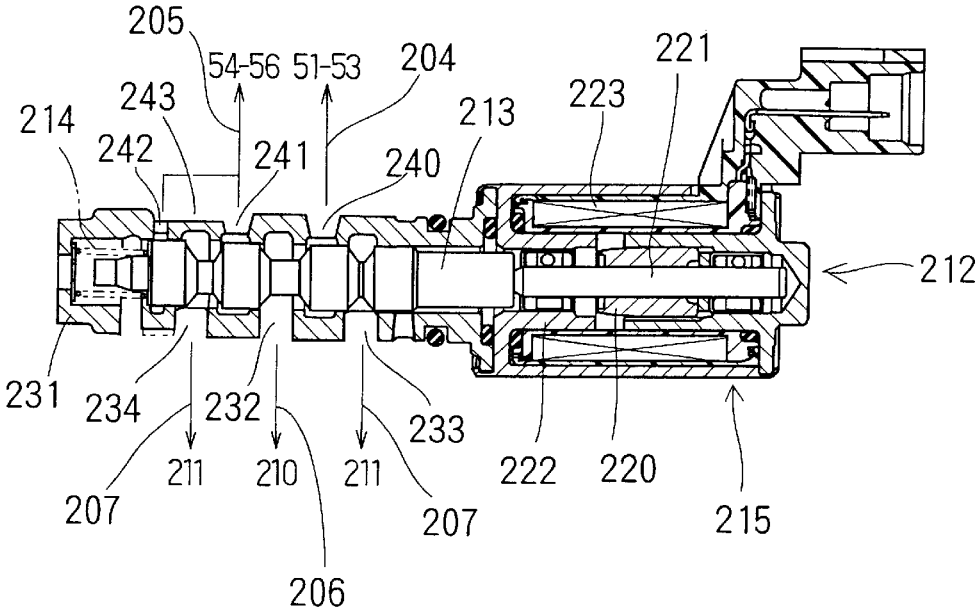
FIG. 7 is a cross-sectional view showing the operating state of the changeover valve (first embodiment)

When the coil 223 is de-energized, the spool 213 is urged by the force of the spring 214 to a position shown in FIG. 7. The retard port 240 communicates with the input port 232, and the advance port 241 communicates with the drain port 234. The communication port 242 is shut off from communication with the drain port 234. Therefore, the oil pressure in each retard oil pressure chamber increases, and the oil pressure in each advance oil pressure chamber decreases.

The position of movement of the spool 213 is changed by controlling the amount of the electric current supplied into the coil 223, to adjust the oil pressure in each oil pressure chamber and each retard oil pressure chamber, thereby controlling the relative rotational position the vane rotor 15 with respect to the shoe housing 12.

The use of the above-described oil supply structure enables the supply of the operation oil from the oil pump 210 to the retard oil pressure chambers 51, 52 and 53, the advance oil pressure chambers 54, 55, and 56, and the oil pressure chambers 42, 45, and also enables the discharge of the operation oil from each oil pressure chamber to the drain 211.

Next, an operation of the valve timing adjusting device 1 will be explained.

When the ignition key is turned off to stop the engine, the interruption of supply of the electric current to the ECU 300 is retarded by the relay circuit. When the ECU 300 detects the ignition key turned off, the ECU 300 turns on the power supply to the linear solenoid 215, so that the valve section 213*c* will be selected, thereby operating in the state shown in FIG. 6. The oil is supplied to each advance oil pressure chamber and the oil pressure chamber 45, and each retard oil pressure chamber and the oil pressure chamber 42 open to the drain. Therefore, the vane rotor 15 rotates to the advance side with respect to the shoe housing 12. An advance control means in the present invention includes the ECU 300 and the changeover valve 212.

The oil passage 48 does not communicate with the recess space 49 even when the stopper piston 32 has reached the intermediate position in which the stopper piston 32 fits in the fitting hole 41 from the retard side. Therefore, the damper chamber 46 is tightly closed, thereby working as a damper. Therefore, the stopper piston 32 does not move toward the fitting hole 41. When the stopper piston 32 rotates to the advance side over the intermediate position, the damper chamber 46 communicates with advance oil pressure chamber 54 through the recess space 49, so that the damper chamber 46 is opened and therefore does not work as a damper.

When the damper chamber 46 is opened, the stopper piston 32 is moved by the urging force of the spring 37 toward the fitting hole 41. On the way of movement of the stopper piston 32 toward the fitting hole 41, the large-diameter portion 34 shuts off a communication between the through hole 30*a* and the oil pressure chamber 45. However, the oil pressure chamber 45 communicates with the oil pressure chamber 42 through grooves formed on the inner peripheral wall of the first small-diameter portion 33 and on the inner peripheral wall of the guide ring 30, so that the oil pressure chamber 45 is not hermetically sealed. Therefore, the hydraulic fluid chamber 45 does not work as a damper chamber. When the oil pressure chamber 45 communicates with the oil pressure chamber 42, no advance oil pressure is not applied to the oil pressure chamber 45. Therefore, the stopper piston 32 is rapidly moved by the advance oil pressure in the damper chamber 46 toward the fitting member 40. The stopper piston 32 that has moved toward the fitting member 40 first fits in the enlarged hole 43. Then, the vane rotor 15 rotates to the retard side due to the load torque which the camshaft 2 receives until the engine stops, and the stopper piston 32 fits in the fitting hole 41.

When the stopper piston 32 fits in the fitting hole 41 before an engine startup, the phase difference of the vane rotor 15 with respect to the shoe housing 12, that is, the phase difference of the camshaft 2 with respect to the crankshaft, is held at the optimum phase for starting the engine. Thus, the engine can reliably start up within a short time.

When the engine is started during a cold state and when the engine is stopped before the operation oil temperature rises, the operation oil is low in temperature and has high viscosity. Therefore, when the vane rotor 15 is rotated to the advance side over the intermediate position with respect to the shoe housing 12 when the engine is stopped, the engine might stall due to the operation oil viscosity before the vane rotor 15 reaches the intermediate position. That is, the engine stalls when the vane rotor 15 is positioned at the advance side over the intermediate position with respect to the shoe housing 12.

When the engine is left unstarted after a stall, the operation oil might leak out at the seal and might not be filled in each oil pressure chamber and the oil passage. Therefore, when the engine is started when the stopper piston 32 remains out of the fitting hole 41, the vane rotor 15 is turned to the retard side by the load torque acting on the camshaft 2, thereby allowing the stopper piston 32 to fit in the fitting hole 41.

However, when the engine is started immediately from the state that the vane rotor 15 is positioned at the advance side over the intermediate position with respect to the shoe housing 12, the oil pressure in each advance oil pressure chamber rises immediately because the oil passage and each advance oil pressure chamber are full of the operation oil. Therefore, the vane rotor 15 does not rotate to the retard side even when the load torque at the time of engine startup acts on the vane rotor 15. Thus, the engine starts when the vane rotor 15 is at the advance side over the intermediate position with respect to the shoe housing 12, that is, when the camshaft 2 is at the advance side over the intermediate position with respect to the crankshaft. For example, when the engine is started at an advanced valve timing of intake valve, the valve timings to open the intake and exhaust valves overlap each other, thereby resulting in a failure of engine startup.

In the first embodiment, however, the valve section 213*d* is selected for a predetermined period by an instruction from the ECU 300 at the engine start. In this state, the operation oil is discharged from each advance oil pressure chamber while being supplied to each advance oil pressure chamber, and at the same time the operation oil is discharged from each retard oil pressure chamber. Also, the fluid passage area of the changeover valve 212 through which the drain port 234 and the communication port 242 are connected is smaller, or slightly smaller, than that of the changeover valve 212 connecting the input port 232 with the advance port 241. Therefore, the oil pressure is low although the operation oil is filled in each advance oil pressure chamber. When the engine is started while the vane rotor 15 is positioned at the advance side over the intermediate position with respect to the shoe housing 12, the vane rotor 15 rotates to the retard side with respect to the shoe housing 12 when the load torque on the retard side is applied, because the oil pressure in each advance oil pressure chamber is low. Then, when the vane rotor 15 reaches the intermediate position, the stopper piston 32 fits in the fitting hole 41, thereby holding the rotational position of the vane rotor 15 with respect to the shoe housing 12 at the intermediate position, and accordingly properly stating the engine.

After engine startup with the valve section 213*d* selected for a predetermined time, the ECU 300 selects the valve section 213*c*. The operation oil is supplied to each advance oil pressure chamber and the oil pressure chamber 45, and each retard oil pressure chamber and the oil pressure chamber 42 are opened to the drain. However, the stopper piston 32 remains in the fitting hole 41 until the advance oil pressure reaches a predetermined pressure, so that the relative rotation of the vane rotor 15 is locked with respect to the shoe housing 12.

After the engine is started, when the oil pressure in each advance oil pressure chamber and the oil pressure chamber 45 increases to a predetermined pressure, the stopper piston 32 goes out of the fitting hole 41, thereby allowing the relative rotation, that is, the phase control, of the vane rotor 15 with respect to the shoe housing 12.

After the engine startup, when the oil pressure increases sufficiently, any one of the valve sections 213*a*, 213*b*, and 213*c* of the spool 213 is selected by an instruction of the ECU 300. By this, supply of the operation oil to each oil pressure chamber and draining of the oil from each oil pressure chamber is controlled, and the relation rotation of the vane rotor 15 with respect to the shoe housing 12 is controlled.

In the first embodiment, when the engine is started in a low oil pressure, the stopper piston 32 might sometimes come out of the fitting hole 41 due to oil pressure fluctuation. However, since each advance hydraulic fluid chamber is full of the operation oil, the vane rotor 15 does not suddenly rotate to the retard side even when the camshaft 2 receives the load torque. Therefore, the vane rotor 15 is prevented from hitting against the shoe housing 12. Furthermore, since the operation oil is circulating in each advance chamber and oil passage, sliding surfaces of these members are lubricated, thereby preventing seizure of sliding portions during engine startup operation.

In the first embodiment, when the ignition key is turned off to stop the engine, electric power supply to the ECU 300 is continued for a predetermined period, so that the ECU 300 energizes the linear solenoid 215, thereby selecting the valve section 213*d* to supply the operation oil to each advance oil pressure chamber to performance advance control. Alternatively, it is possible to accomplish the advance control by adopting such an oil supply structure that when the valve section 213*c* is selected, the operation oil is supplied to each advance oil pressure chamber, and when the valve section 213*a* is selected, the operation oil is supplied to each retard oil pressure chamber. In this case, when the supply of the electric current to the ECU 300 is interrupted simultaneously with turning off the ignition key, the valve section 213*c* is selected by the urging force of the spring 214, and the operation oil is supplied to each advance oil pressure chamber.

(Second Embodiment)

Figure 8:
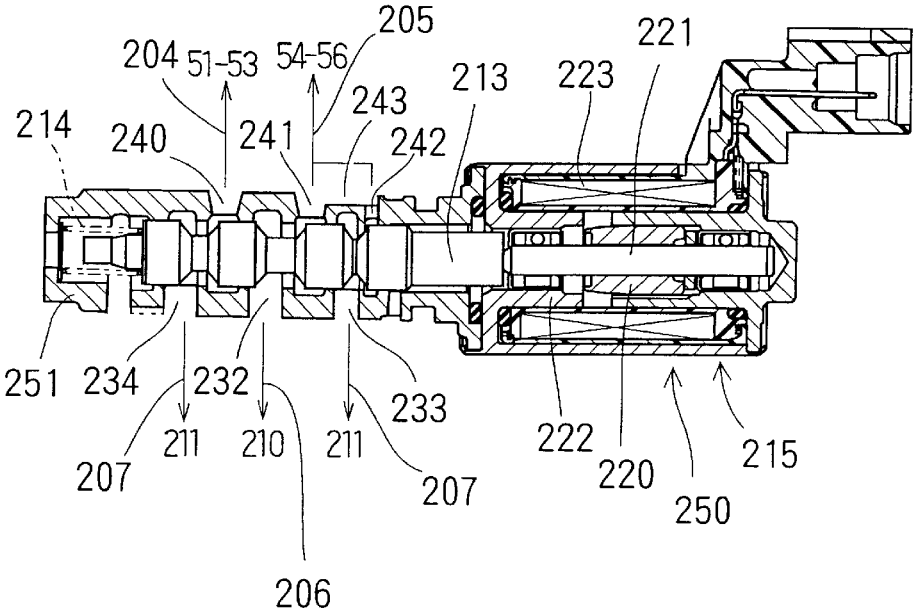
FIG. 8 is a cross-sectional view showing an operating state of a changeover valve (second embodiment)
Figure 9:
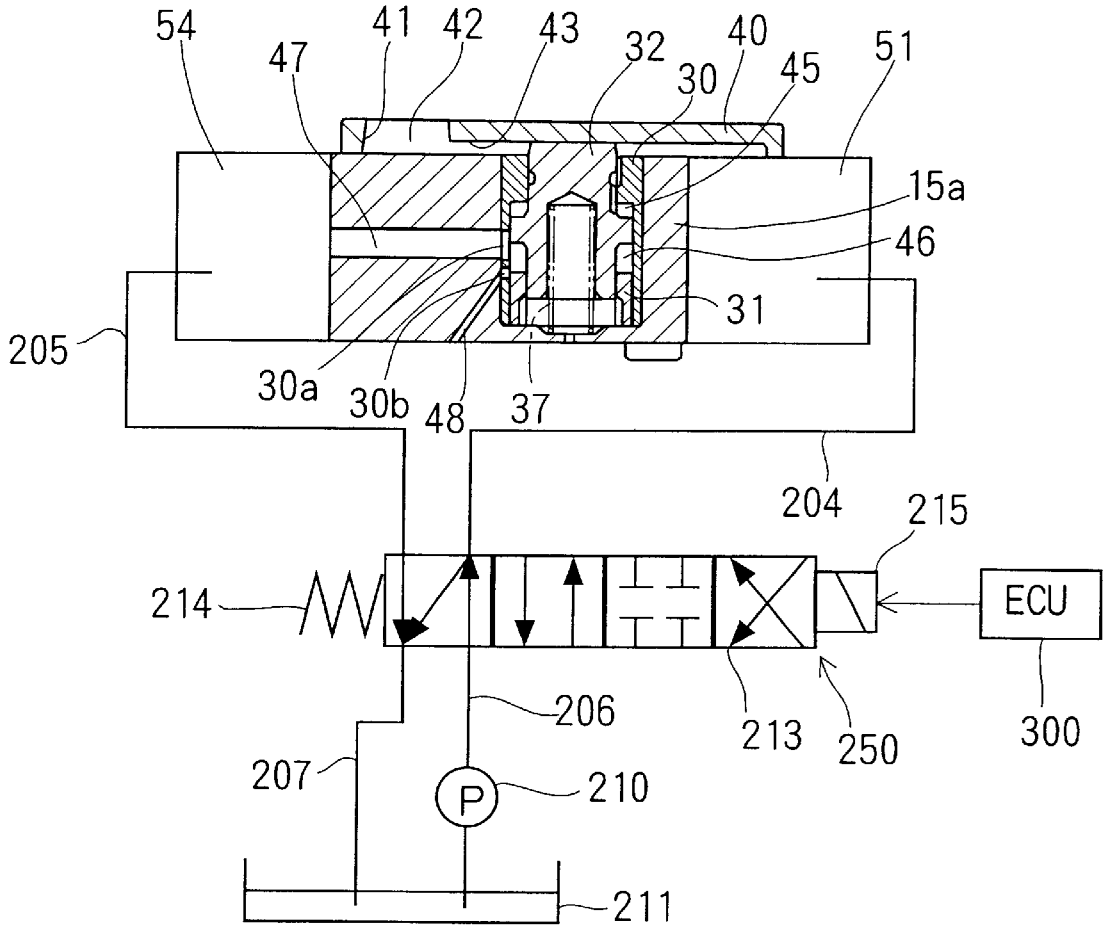
FIG. 9 is a schematic view showing a cross-sectional view showing a stopper piston and its vicinity of the valve timing adjusting device and showing a changeover valve (third embodiment)

The second embodiment of the present invention is shown in FIG. 8. In a changeover valve 250 of the second embodiment, the retard port 240, advance port 241, and communication port 242 are axially arranged in a reversed order of the first embodiment. The changeover valve 250 is substantially the same in other structure as the first embodiment.

When supply of the electric current to the coil 223 is interrupted, the spool 213 is moved to the position shown in FIG. 8 by the urging force of the spring 214. Then, the input port 232 communicates with the advance port 241, and the communication port 242 communicates with the drain port 233. The retard port 240 communicates with the drain port 234. Therefore, in such an electric system failure that the supply of the electric current to the coil 223 from the ECU 300 fails, the operation oil is discharged from each advance oil pressure chamber while being supplied to each advance oil pressure chamber, and the operation oil is discharged from each retard oil pressure chamber.

For example, when the valve timing of the intake valve is controlled by the valve timing adjusting device which has the changeover valve 250, the operation oil is discharged from each advance oil pressure chamber while being supplied to each advance oil pressure chamber in the event of a failure, thereby preventing the valve timing of the intake valve from becoming the most retarded timing.

(Third Embodiment)

The third embodiment of the present invention is shown in FIGS. 9–12. Substantially same members as those in the first embodiment are designated by the same reference numerals.

The changeover valve 250 of the third embodiment is of the same configuration as the changeover valve 250 of the second embodiment, with the exception that the retard port 240 of the second embodiment is the advance port 241 in the third embodiment, and the advance port 241 of the second embodiment is the retard port 240 in the third embodiment. The retard port 240 communicates with the communication port 242 through the communication passage 243 formed on the outer peripheral wall of the housing 251.

Figure 10:
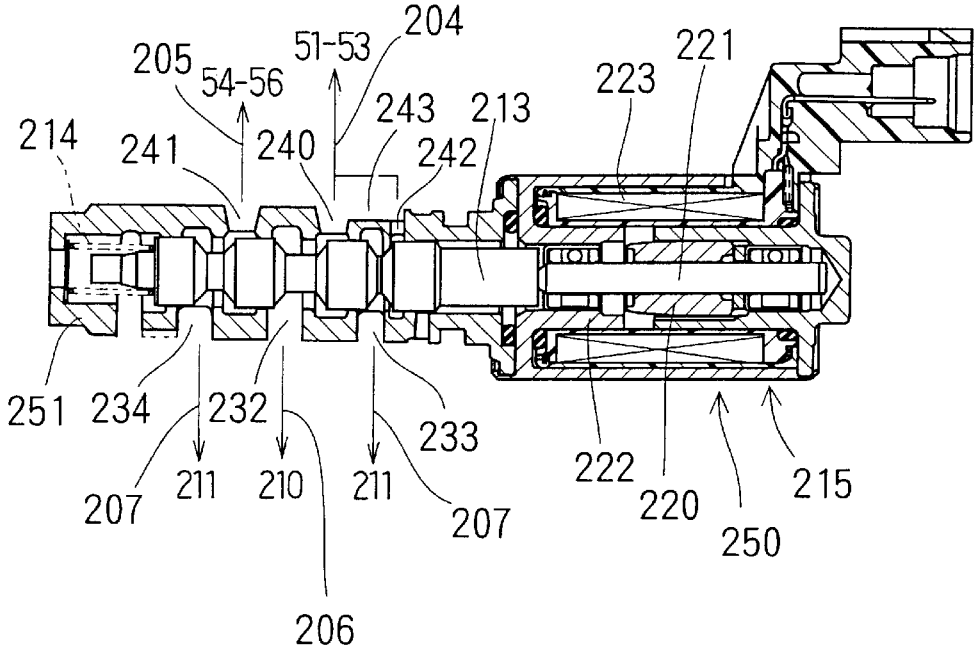
FIG. 10 is a cross-sectional view showing an operating state of the changeover valve (third embodiment)

FIG. 10 shows a de-energized state of the coil 223. The spool 213 comes to the position shown in FIG. 12 due to the urging force of the spring 214. The retard port 240 communicates with the input port 232, and the communication port 242 communicates with the drain port 233. The advance port 241 communicates with the drain port 234. Therefore, the operation oil is discharged from each retard oil pressure chamber while being supplied to each retard oil pressure chamber, and also being discharged from each advance oil pressure chamber. The fluid passage area of the changeover valve 250 connecting between the drain port 233 and the communication port 242 is smaller, or a little smaller, than the fluid passage area of the changeover valve 250 connecting between the inlet port 232 and the retard port 240. Therefore, the operation oil pressure remains low though the oil is filled in each retard oil pressure chamber.

Figure 11:
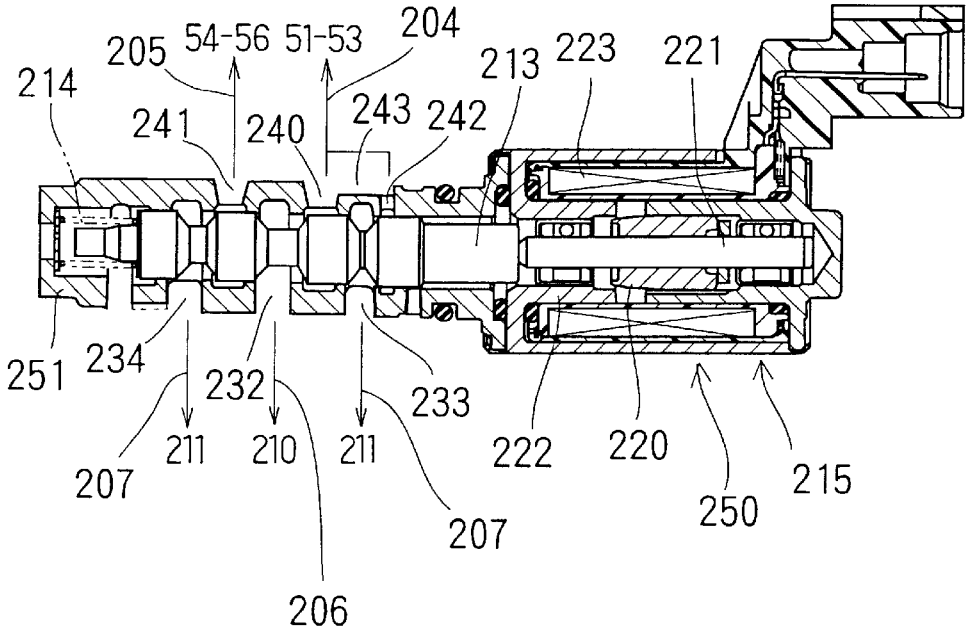
FIG. 11 is a cross-sectional view showing an operating state of the changeover valve (third embodiment)

When the coil 223 is energized, the spool 213 comes to the position shown in FIG. 11. The retard port 240 communicates with the input port 232, and the communication port 242 is shut off from communication with the drain port 233. The advance port 241 communicates with the drain port 234. Therefore the oil pressure in each retard oil pressure chamber increases.

Figure 12:
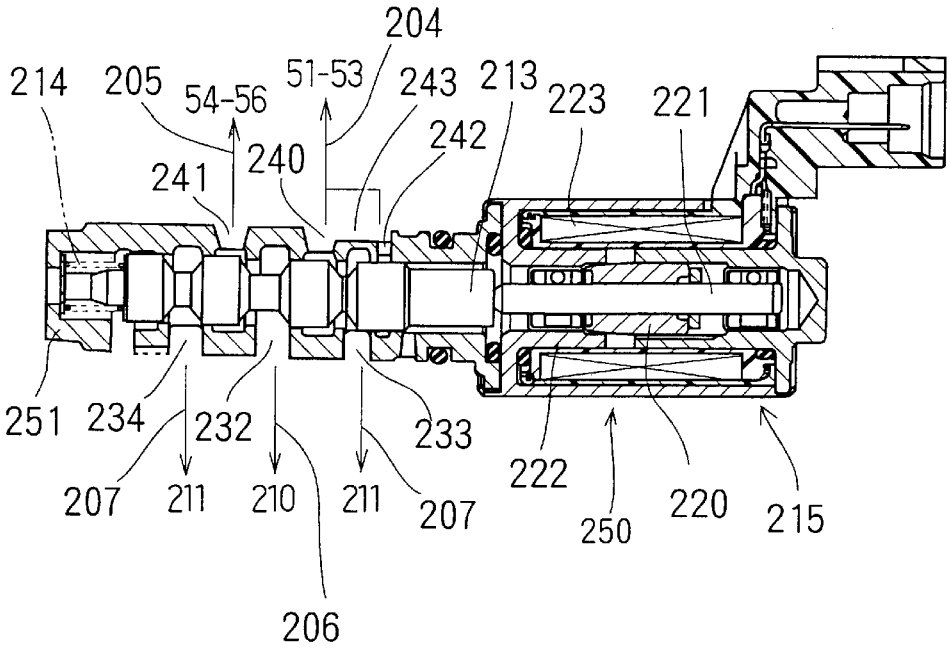
FIG. 12 is a cross-sectional view showing an operating state of the changeover valve (third embodiment)

When the maximum electric current is supplied to the coil 223, the spool 213 comes to the position shown in FIG. 12. At this time, the retard port 240 communicates with the drain port 233, and the communication port 242 is shut off from communication with the drain port 233. The advance port 241 communicates with the input port 232. Therefore, the oil pressure in each advance oil pressure chamber increases.

(Fourth Embodiment)

Figure 13:
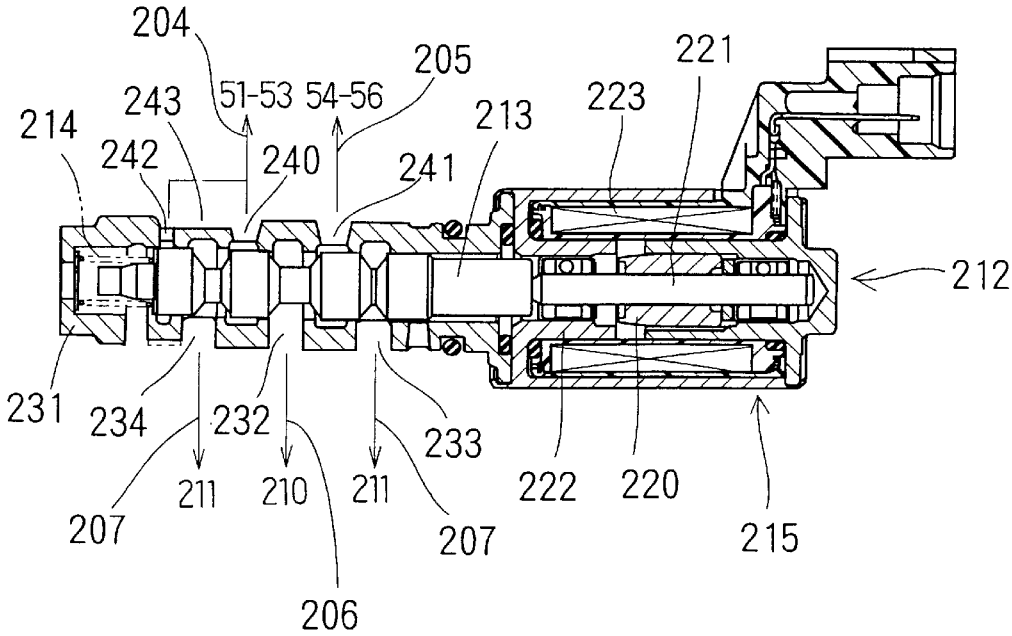
FIG. 13 is a cross-sectional view showing an operating state of a changeover valve (fourth embodiment)

The fourth embodiment of the present invention is shown in FIG. 13. The changeover valve 212 of the fourth embodiment is of the same configuration as the changeover valve 212 of the first embodiment. However, the retard port 240 of the first embodiment is the retard port 241 of the fourth embodiment, and the advance port 241 of the first embodiment is the retard port 240 in the fourth embodiment. The retard port 240 communicates with the communication port 242 through the communication passage 243 formed on the outer peripheral wall of the housing 251.

When the coil 223 is de-energized, the spool 213 is moved by the urging force of the spring 214 to the position shown in FIG. 13. The retard port 240 communicates with the drain port 234, and the communication port 242 is shut off from communication with the drain port 234. The advance port 241 communicates with the input port 232. Therefore, in the event of such a failure as disconnection of the coil 223 and inability to supply the electric current to the coil 223, the operation oil is supplied to each advance oil pressure chamber, and simultaneously is discharged from each retard oil pressure chamber. Therefore, the valve timing is prevented from becoming to the most retarded angle at the failure of the electric system.

In the above-described first through fourth embodiments, the retard port 240 or the advance port 241 and the communication port 242 are connected by a communication passage 243 formed on the outer peripheral wall of the housing of the changeover valve. Therefore, there is no need to form a communication passage in other part for connecting the advance port 240 or the advance port 241 with the communication port 242.

(Fifth Embodiment)

Figure 14:
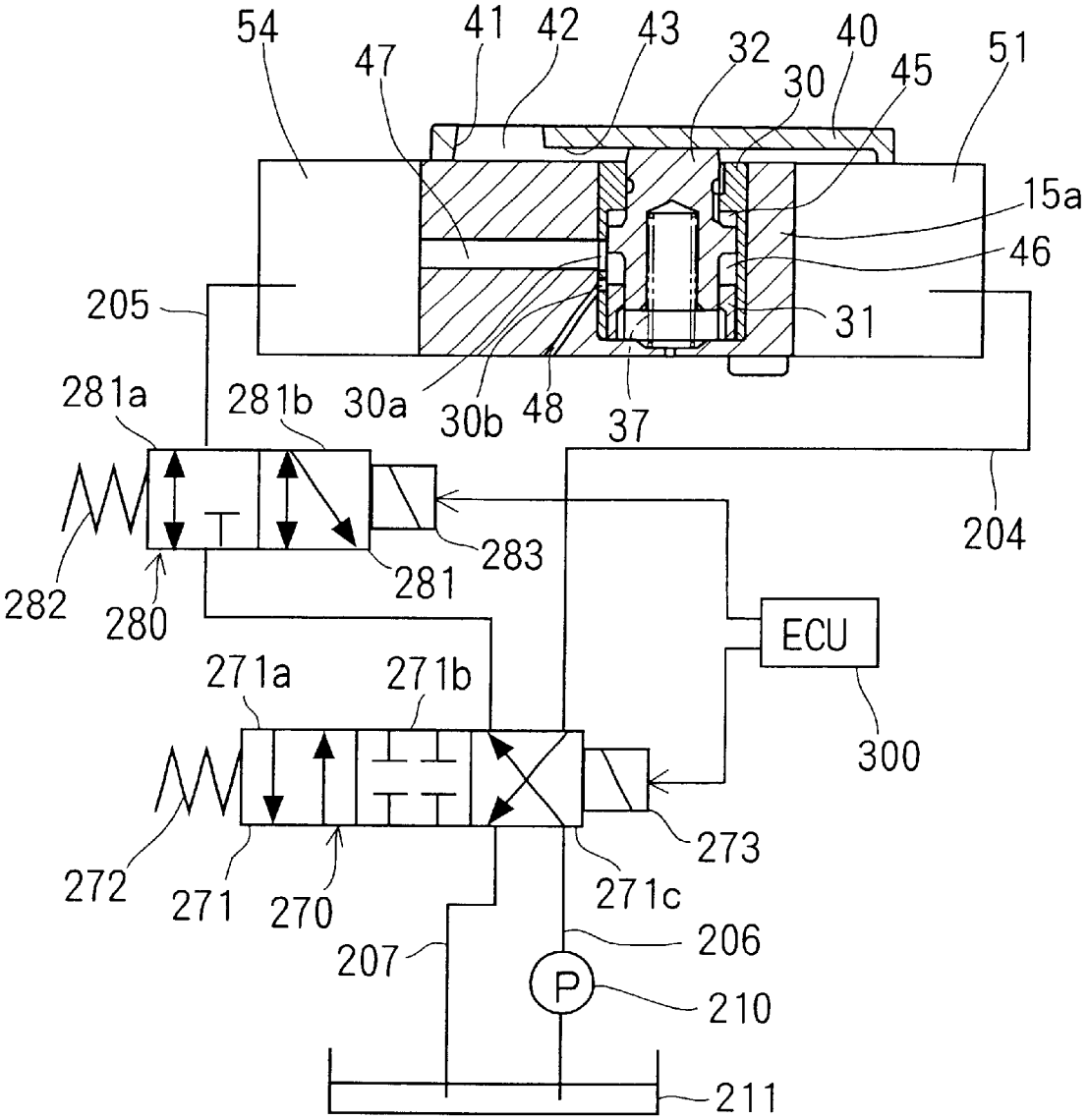
FIG. 14 is a schematic view showing a cross-sectional view showing a stopper piston and its vicinity of the valve timing adjusting device and showing a changeover valve (fifth embodiment).

The fifth embodiment of the present invention is shown in FIG. 14, in which substantially same members as those in the first embodiment are designated by the same reference numerals.

A changeover valve 270 and a changeover valve 280 are electromagnetically-driven valve devices having a spool 271 and a spool 280 respectively, and forming a changeover means. During normal engine operation, the supply of the electric current to a solenoid 283 of the changeover valve 280 is interrupted, and a valve section 281 of the changeover valve 280 is selected. Therefore, it is possible to control the oil pressure in each advance oil pressure chamber and each retard oil pressure chamber by selecting valve sections 271*a*, 271*b*, and 271*c* of the spool 271 through the control of the electric current to be supplied to a solenoid 273 of the changeover valve 271.

At the engine start, the electric current is supplied to the solenoid 273 of the changeover valve 270 for a predetermined period to select the valve section 271*c* against the urging force of a spring 272. At the same time, the electric current is also supplied to the solenoid 283 of the changeover valve 280 to select the valve section 281*b* against the urging force of a spring 282. Then, the operation oil is supplied to each advance oil pressure chamber while being discharged from each advance oil pressure chamber, and also from each retard oil pressure chamber.

MODIFICATIONS

In the above-described embodiments of the present invention, the enlarged hole 43 was formed in the fitting member 40 in addition to the fitting hole 41. Alternatively, there may be provided only the fitting hole 41 without forming the enlarged hole 43.

In the above-described embodiments, the valve timing adjusting device for driving the intake valve was explained. Alternatively, only the exhaust valve or both the intake valve and the exhaust valve may be driven by the valve timing adjusting device in the embodiments.

In the above-described embodiments, the stopper piston moves axially to fit into the fitting hole. Alternatively, the stopper piston may move radially to fit into the fitting hole. Further, the stopper piston may be held within the housing member, and a fitting hole and an enlarged hole may be formed within the vane rotor.

In the above-described embodiments, the rotation of the crankshaft is transmitted to the camshaft through the chain sprocket. Alternatively, a timing pulley or a timing gear may be used. Further, a vane may receive a driving force of the crankshaft as a driving shaft, and the camshaft as a driven shaft and the housing member may be rotated with together.

What is claimed is:

1. A valve timing adjusting device provided in a driving force transmission system which transmits a driving force from a driving shaft of an internal combustion engine to a camshaft which drives to open and close at least one of an intake valve and an exhaust valve, for adjusting opening-closing timing of at least one of said intake valve and said exhaust valve, comprising:

a driving-side rotor rotating together with said driving shaft of the internal combustion engine, said driving-side rotor including a housing chamber therein;

a driven-side rotor provided in said housing chamber and rotating together with said camshaft, said driven-side rotor including vanes partitioning said housing chamber into retard chambers and advance chambers, said driven-side rotor driven to rotate with respect to said driving-side rotor within a predetermined range of angle by a fluid pressure in said retard chambers and said advance chambers;

a restraining means including a contacting portion provided within said driven-side rotor and a contacted portion provided within said driving-side rotor, said restraining means restrains a relative rotation of said driven-side rotor with respect to said driving-side rotor when said contacting portion contacts said contacted portion while said driven-side rotor is at an intermediate position between both ends in a circumferential direction of the predetermined range of angle, said restraining means further including an urging means for urging said contacting portion toward said contacted portion;

an advance fluid passage being capable of supplying the fluid into said advance chambers and discharging the fluid therefrom;

a retard fluid passage being capable of supplying the fluid into said retard chambers and to discharging the fluid therefrom; and a changeover means for changing over connection between said advance fluid passage and a fluid supply source or a drain, and for changing over connection between a retard fluid passage and said fluid supply source or said drain, wherein said changeover means is capable of simultaneously connecting said advance fluid passage with said fluid supply source, and said advance fluid passage with said drain.

2. A valve timing adjusting device according to claim 1, further including an advance control means for supplying the fluid to said advance chamber when the engine is stopped.

3. A valve timing adjusting device according to claim 1, wherein said changeover means is a valve device having a cylindrical housing and a valve member, said cylindrical housing has a plurality of through holes for connection of said advance fluid passage, said retard fluid passage, said fluid supply source, and said drain, said valve member is reciprocally movably housed in said cylindrical housing and is moved to change communication positions among said through holes, and said valve device is capable of selecting, by moving said valve member, a fluid passage structure connecting said advance fluid passage with said fluid supply source, and said advance fluid passage with said drain.

4. A valve timing adjusting device according to claim 3, wherein said valve device includes a valve operating means for urging said valve member in one direction, and an electromagnetically driving portion for driving said valve member in an opposite direction of said valve operating means, and when an electric current is not supplied to said electromagnetically driving portion, said valve member simultaneously connects said advance fluid passage with said fluid supply source, and said advance fluid passage with said drain by an urging force of said valve operating means.

5. A valve timing adjusting device according to claim 3, wherein said through holes of said cylindrical housing include an advance port and a communication port communicating with said advance flow passage, a retard port communicating with said retard flow passage, an input port connected to said fluid supply source, and a drain port connected to said drain, and said advance port communicates with said input port, and said communication port communicates with said drain port in accordance with a moving position of said valve member.

6. A valve timing adjusting device according to claim 5, wherein said cylindrical housing has a communication passage formed on an outer peripheral wall thereof, and said communication passage allows said advance port to communicate with said communication port.

7. A valve timing adjusting device according to claim 5, wherein said drain port that can communicate with said advance port and said communication port are common.

8. A valve timing adjusting device according to claim 1, further including a control means to control said changeover means so as to connect said advance fluid passage with said fluid supply source and said drain for a predetermined period when the engine starts.

9. A valve timing adjusting device according to claim 1, wherein in said changeover means, a fluid passage area for connection between said advance fluid passage and said drain is less than a fluid passage area for connection between said advance fluid passage and said fluid supply source.

10. A valve timing adjusting device provided in a driving force transmission system which transmits a driving force from a driving shaft of an internal combustion engine to a camshaft which drives to open and close at least one of an intake valve and an exhaust valve, for adjusting opening-closing timing of at least one of said intake valve and said exhaust valve, comprising:

a driving-side rotor rotating together with said driving shaft of the internal combustion engine, said driving-side rotor including a housing chamber therein;

a driven-side rotor provided in said housing chamber and rotating together with said camshaft, said driven-side rotor including vanes partitioning said housing chamber into retard chambers and advance chambers, said driven-side rotor driven to rotate with respect to said driving-side rotor within a predetermined range of angle by a fluid pressure in said retard chambers and said advance chambers;

a restraining means including a contacting portion provided within said driven-side rotor and a contacted portion provided within said driving-side rotor, said restraining means restrains a relative rotation of said driven-side rotor with respect to said driving-side rotor when said contacting portion contacts said contacted portion while said driven-side rotor is at an intermediate position between both ends in a circumferential direction of the predetermined range of angle, said restraining means further including an urging means for urging said contacting portion toward said contacted portion;

an advance fluid passage being capable of supplying the fluid into said advance chambers and discharging the fluid therefrom;

a retard fluid passage being capable of supplying the fluid into said retard chambers and to discharging the fluid therefrom; and a changeover means for changing over connection between said advance fluid passage and a fluid supply source or a drain, and for changing over connection between a retard fluid passage and said fluid supply source or said drain, wherein said changeover means is capable of simultaneously connecting said retard fluid passage with said fluid supply source, and said retard fluid passage with said drain.

11. A valve timing adjusting device according to claim 10, further including an advance control means for supplying the fluid to said advance chamber when the engine is stopped.

12. A valve timing adjusting device according to claim 10, wherein said changeover means is a valve device having a cylindrical housing and a valve member, said cylindrical housing has a plurality of through holes for connection of said advance fluid passage, said retard fluid passage, said fluid supply source, and said drain said valve member is reciprocally movably housed in said cylindrical housing and is moved to change communication positions among said through holes, and said valve device is capable of selecting, by moving said valve member, a fluid passage structure connecting said retard fluid passage with said fluid supply source, and said retard fluid passage with said drain.

13. A valve timing adjusting device according to claim 12, wherein said valve device includes a valve operating means for urging said valve member in one direction, and an electromagnetically driving portion for driving said valve member in an opposite direction of said valve operating means, and when an electric current is not supplied to said electromagnetically driving portion, said valve member simultaneously connects said retard fluid passage with said fluid supply source, and said retard fluid passage with said drain by an urging force of said valve operating means.

14. A valve timing adjusting device according to claim 12, wherein said through holes of said cylindrical housing include an retard port and a communication port communicating with said retard flow passage, an advance port communicating with said advance flow passage, an input port connected to said fluid supply source, and a drain port connected to said drain, and said retard port communicates with said input port, and said communication port communicates with said drain port in accordance with a moving position of said valve member.

15. A valve timing adjusting device according to claim 14, wherein said cylindrical housing has a communication passage formed on an outer peripheral wall thereof, and said communication passage allows said retard port to communicate with said communication port.

16. A valve timing adjusting device according to claim 14, wherein said drain port that can communicate with said retard port and said communication port are common.

17. A valve timing adjusting device according to claim 10, further including a control means to control said changeover means so as to connect said retard fluid passage with said fluid supply source and said drain for a predetermined period when the engine starts.

18. A valve timing adjusting device according to claim 1, wherein in said changeover means, a fluid passage area for connection between said retard fluid passage and said drain is less than a fluid passage area for connection between said retard fluid passage and said fluid supply source.

* * * * *